United States Patent [19]

Arnold et al.

[11] 4,353,489

[45] Oct. 12, 1982

[54] COMBINED LID AND POURING SPOUT FOR A CONTAINER HAVING A U-SHAPED SEALING CHANNEL

[76] Inventors: Everett L. Arnold, 459 Juniper St.; James M. Moore, 1144 Northfield Cir., both of Warminster, Pa. 18974

[21] Appl. No.: 189,632

[22] Filed: Sep. 22, 1980

[51] Int. Cl.[3] ..... B65D 25/48

[52] U.S. Cl. ..... 222/570

[58] Field of Search ..... 222/569, 570, 527, 528, 222/529, 530, 498, 571, 562, 566; 215/317, 324, 325; 220/307

[56] References Cited

U.S. PATENT DOCUMENTS

| | | | |
|---|---|---|---|
| 2,527,053 | 10/1950 | Bedford, Jr. | 220/307 X |
| 3,117,701 | 1/1964 | Stull | 222/571 X |
| 3,270,924 | 9/1966 | Kitabayashi | 222/498 X |
| 3,894,650 | 7/1975 | Crump | 222/570 X |
| 4,230,238 | 10/1980 | Wilson | 222/570 X |

*Primary Examiner*—Stanley H. Tollberg
*Attorney, Agent, or Firm*—Robert J. Mooney

[57] ABSTRACT

A lid is disclosed for a conventional liquid container of the type having an annular U-shaped sealing channel at the open end thereof. The lid includes an upwardly-cambered disc-shaped base having a tapered annular skirt depending downwardly from the base near its periphery. A plurality of wedge-shaped tangs depend downwardly from the skirt in a radial pattern each tang being separated by a square interstice to allow independent movement of the tangs. A sealing groove is formed around the skirt between the tangs and the base for securely engaging the inside of the channel and thereby preventing liquid from entering the channel. A conically-shaped pouring spout preferably projects upwardly from the base at an inclined attitude to provide access for ambient air to the inside of the container during pouring thereby promoting a controllable rate of flow. The spout is provided with a specially configured end having a flared lip to minimize dripping after pouring is completed. The lid may be characterized as a virtually universally fitting, snap-on, self-locking, air-tight container cover, further featuring a self-venting, virtually dripless pouring spout.

2 Claims, 7 Drawing Figures

COMBINED LID AND POURING SPOUT FOR A CONTAINER HAVING A U-SHAPED SEALING CHANNEL

BACKGROUND OF THE INVENTION

The present invention relates to closures and more particularly to an improved lid for sealing a container of viscous liquid, such as paint, and dispensing the liquid therefrom.

Conventional liquid containers are typically provided with a substantially U-shaped annular sealing channel which receives a complementary-shaped lid used to close the container. An example of this type of container is a paint can having a sealing channel and a circular inner rim that terminates in an annular bead surrounding the top of the can. In the process of mixing and pouring paint from such a can, it is practically impossible to prevent paint from accumulating in the sealing channel and from running down the outside of the can. The top of the can does not serve as a guide or function as a spout to minimize spilling and dripping of the paint. This wasteful and messy problem is prevalent not only with paint cans but also with other similar containers that are used to store viscous fluids.

A variety of covering and pouring devices have been developed for such containers. However, such devices have not been entirely satisfactory in universally fitting and sealing liquid containers because of dimensional variations associated with the rims of ostensibly identically sized containers. Because the fit is not always uniform, an air tight seal is not always achieved which results in film formation or "skimming" of the liquid in the container and penetration of the liquid into the U-shaped channel where it accumulates and overflows when the liquid is mixed or dispensed. Furthermore, existing lids having built-in pouring spouts have not proven sufficiently self-venting so as to permit the liquid to be poured from the container in a smooth, even flow at a rate controlled by the user.

SUMMARY OF THE INVENTION

Accordingly, it is a general purpose and object of the present invention to provide an improved lid for covering containers and cans containing viscous liquids, particularly paint, and for pouring such liquids from the containers without waste or mess.

Another object of the present invention is to provide a covering device that replaces the lid of a conventional paint container and which tightly engages the open end of the container despite nonuniformities in the size of the container so that unused paint may be stored for extended periods without spoiling or skimming of the paint.

Still another object of the present invention is to provide an adjustable-fitting replacement cover for conventional paint containers having an integral pouring spout that is self-venting so that during normal pouring operations, paint is dispensed in a smooth, even flow at a rate controllable by the user.

A further object of the present invention is to provide a cover with an integral pouring spout that dispenses paint from a conventional container without spilling or dripping of the paint while preventing the paint from entering the U-shaped sealing channel of the container.

A still further object of the present invention is to provide a combination covering and pouring device that is sturdy and reliable, easy to handle and keep clean, and economical to manufacture.

Briefly, these and other aspects of the present invention are accomplished by a lid for a conventional liquid container of the type having an annular U-shaped channel at the open end thereof. The lid includes an upwardly-cambered disc-shaped base having an annular skirt depending downwardly from the base near its periphery. A plurality of wedge-shaped tangs, depend downwardly from the skirt in a radial pattern, each tang being separated by a square interstices to allow independent movement of the tangs. A sealing groove is formed around the skirt between the tangs and the base for securely engaging the inner rim of a U-shaped container channel to thereby prevent liquid from entering the channel. A conically-shaped pouring spout, having a certain minimum internal diameter, preferably projects upwardly from the base at an inclined attitude. The spout is designed to insure that ambient air has access to the interior of the container during pouring thereby promoting a controllable rate of flow. The spout is provided with a specially configured end having a flared lip to minimize dripping after pouring is completed. A removable cap for the flared lip of the spout is provided to permit extended storage, and an integral tab projecting outwardly from the base of the device opposite the spout facilitates disengagement and removal of the device from the container.

For a better understanding of these and other aspects of the present invention, reference may be made to the following detailed description taken in conjunction with the accompanying drawings in which like reference characters designate like parts throughout the figures thereof.

DESCRIPTION OF THE PREFERRED EMBODIMENT

Figure 1:
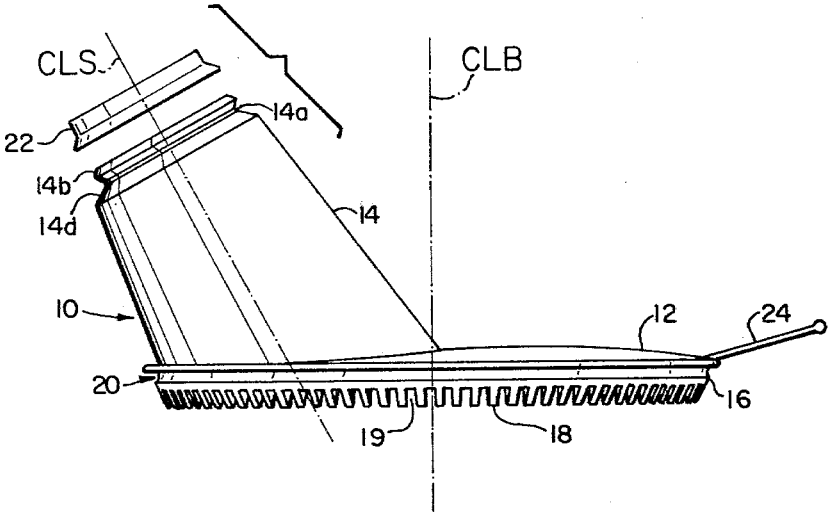
FIG. 1 is a side elevation view of a lid according to the present invention.
Figure 2:
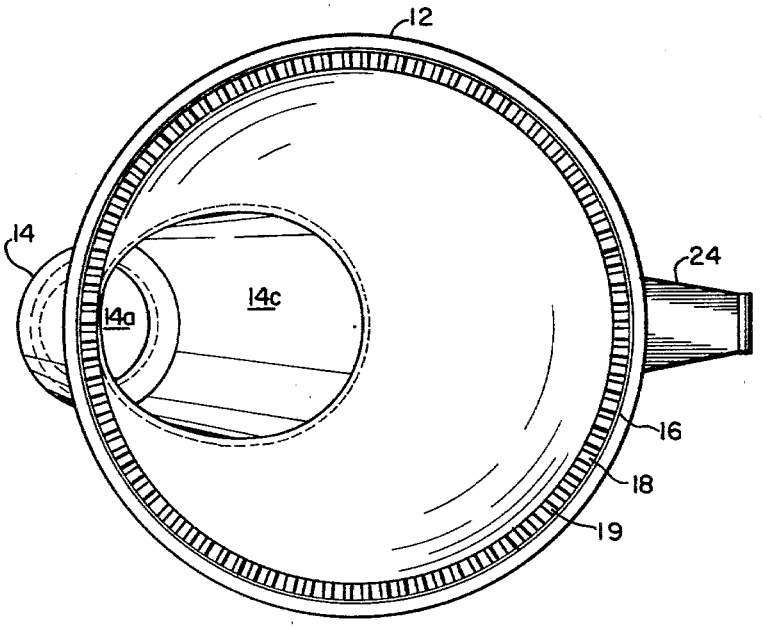
FIG. 2 is a bottom view of the lid of FIG. 1.

Referring now to FIGS. 1 and 2, there is shown a lid 10 having a base 12 formed in the shape of an upwardly-cambered disc. An annular skirt 16 internal of and substantially concentric with the periphery of base 12 depends downwardly from the bottom of the base 12 and is formed having a downwardly-tapered inner edge **16*a*, better shown in FIG. 4, which provides a desired flexibility. The skirt 16 is provided with a plurality of wedge-shaped tangs 18 downwardly depending from the skirt 16 in a radial pattern. The tangs 18 are equidistantly spaced apart by a respective plurality of interstices 19** having internal corners that are squared to promote independent flexing and bending of the tangs.

A sealing groove 20 which is described in greater detail hereinafter, is formed between the upper portion of the tangs 18 and the bottom of base 12 around the outer circumference of the skirt 16.

A pouring spout 14 projects upwardly from the top of base 12 and is disposed such that the center line (CLS) of the spout is at an inclined attitude with relation to the centerline (CLB) of the base. The spout 14 is conically-shaped tapering inward toward its center line (CLS) as it extends upwardly from the base 12. An elliptical aperture **14*c* is formed in the base 12 at the bottom of spout 14 to accept the overflow of liquid during pouring. The upper portion of spout 14 is provided with an intruding neck 14*d* that feeds a cylindrical spout opening 14*a*. A flared lip 14*b* is provided at the upper end of spout 14 to provide a sharp pouring edge. The lid 10 may be provided with a removable cap 22 configured to be pressed over the upper portion of the spout 14. An integral tab 24 outwardly projecting from the base 12 in the opposite direction of spout 14 is also provided. The tab 24 facilitates removal of the lid 10. The lid 10** of the present invention is preferably fabricated from a low-to-medium density thermoplastic material, such as polyethylene, that has amorphous chemical characteristics and that is tough and flexible, impervious to petroleum and organic-based solvents, and easily cleaned.

Figure 3:
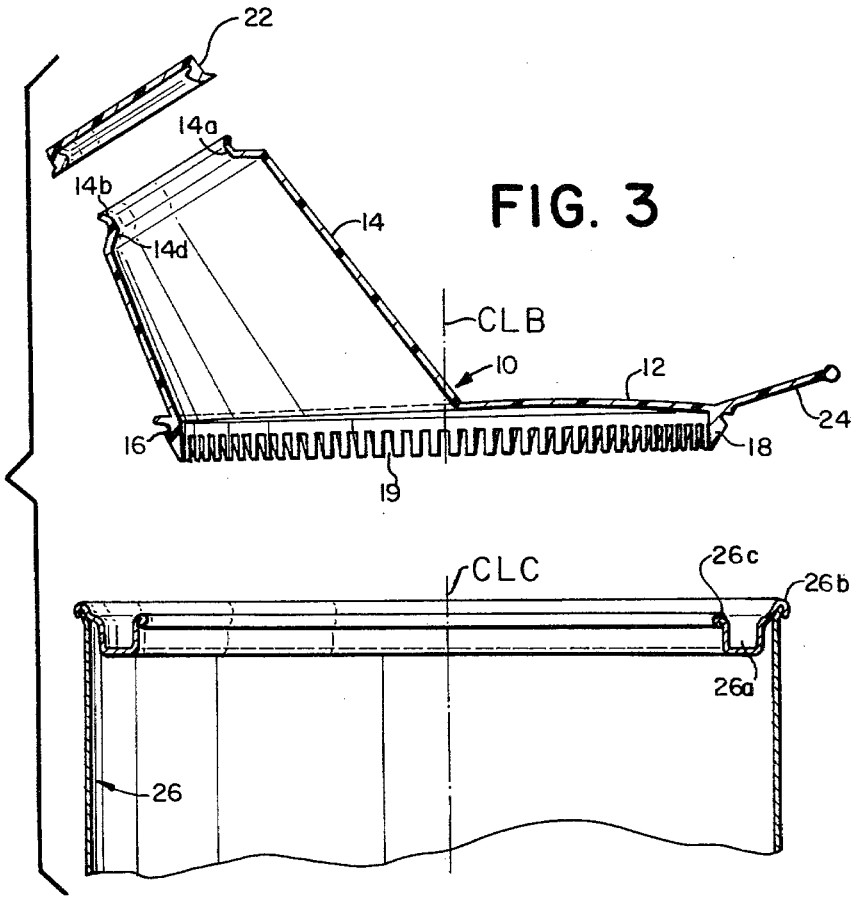
FIG. 3 is a cross-sectional view of the lid of FIG. 1 juxtaposed a conventional paint container shown in partial section.

Referring now to FIG. 3, the lid 10 is shown juxtaposed a conventional paint container 26 of the type having a generally U-shaped sealing channel **26*a* formed at the open end of the container below and between an outer ring bead 26*b* and an inner ring bead 26*c*. For clarity of presentation, the center line (CLB) of the base 12 and the center line (CLC) of the container 26 coincide. The upwardly-cambered base 12 spans and covers the open end of the container 26, extending over the inner ring bead 26*c* and terminating approximately over the center of the U-shaped channel 26*a*. The outer circumference of the skirt 16 is located to coincide substantially with the inner ring bead 26*c* of container 26 so that the sealing groove 20 engages the inner ring bead 26*c*** in a manner to be described in further detail hereinafter.

Figure 4:
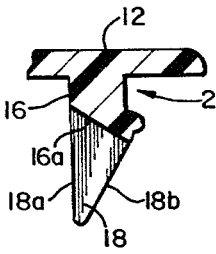
FIG. 4 is an enlarged sectional view of a sealing groove which forms a part of the lid of this invention.

Referring now to FIG. 4 in conjunction with FIG. 3, each tang 18 is shaped in the form of a wedge having an inner surface **18*a* substantially parallel to the center line (CLB) of the base 12 and an outer surface 18*b* that is tapered downward and inward toward the center line (CLB) of the base 12. The outer surface 18*b* of the tang 18 begins its downward taper from a radius intermediate the periphery of the base 12 and the outer circumference of the skirt 16 so that the sealing groove 20 is formed about the skirt between the upper part of each tang and the bottom of the base. Adjacent tangs 18 are spaced apart radially by respective interstices 19 that are formed having square corners to permit each individual tang to move independently of its adjacent tangs. The tangs 18 are of sufficient length to allow the thinnest downward portion thereof to fit within the open end of container 26 and inside the inner ring bead 26*c* for a wedge-like installation of the lid 10** on the container.

Figure 5:
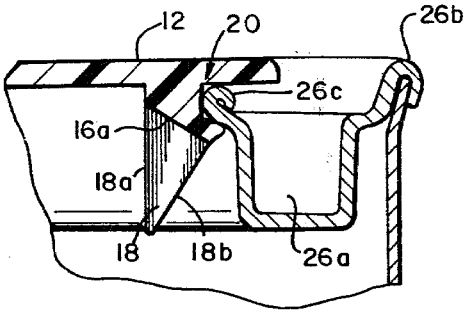
FIG. 5 is an enlarged sectional view of the sealing groove of FIG. 4 shown in an engagement with the container in FIG. 3.

Referring now to FIG. 5 in conjunction with FIG. 3, the sealing groove 20 is sufficiently contoured to accept and snuggly enclose the inner ring bead **26*c* during installation and operation. To properly install the lid 10 and seat the groove 20, the base 12 is handpressed into the open end of container 26 one section at a time around the periphery. Downward pressure upon the periphery of base 12 forces the tapered outer surfaces 18*b* of tangs 18 to urge in contact with the inner ring bead 26*c* of the container 26 and to flex inward towards the center line (CLB) of base 12. As a result, the upwardly-cambered base 12 is further cambered until the tapered outer surfaces 18*b* of the tangs 18 are urged completely over and within the inner ring bead 26*c*, at which time the sealing groove 20 is snapped by a recoil of the cambered base into a properly seated position tightly engaging the inner ring bead and locking the lid 10 onto the container 26. It should be noted that the described integral arrangement of interstitially separated, inwardly-tapered tangs 18, the outwardly-tapered skirt 16 and the upwardly-cambered base 12 provides the lid 10 with a substantial range of flexibility that permits the lid to adjust to and universally fit the inner ring bead 26*c* of the container 26** despite typical variations in its diameter and shape that occur due to manufacturing imperfections and repeated openings and closings of the container.

Figure 6:
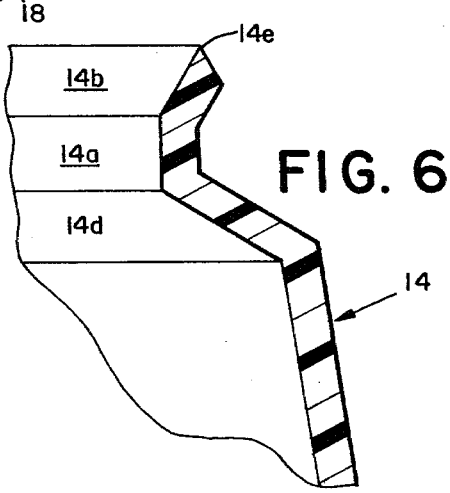
FIG. 6 is a detailed sectional view of a portion of a flared spout lip which forms a part of the lid of this invention.

Referring now to FIG. 6 in conjunction with FIG. 3, the conically-shaped pouring spout 14 is inclined from the center line (CLB) of the base 12 to permit self-venting of the container 26 during pouring operations so that a smooth, even flow of paint or other liquid can be controlled by the user. The cylindrical spout opening **14*a* is of a sufficient diameter to prevent the spout 14 from completely filling while pouring so that air is always allowed to enter the spout opening and flow inward through the spout and thereby prevent a vacuum from forming within container 26. The spout opening 14*a* is fed via the spout neck 14*d* which is angularly configured to limit and control the flow of liquid into the opening. The flared spout lip 14*b* is formed at the uppermost end of spout 14 above the cylindrical opening 14*a* to provide a sharp edge 14*e* that effectively cuts the flow of the paint or other viscous liquid once the container 26** is tilted upright after pouring thereby preventing dripping.

Figure 7:
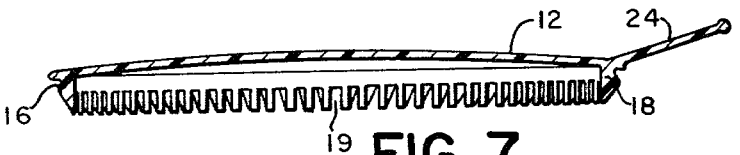
FIG. 7 is a side elevational view of another embodiment of the lid.

It should be understood that lid 10 is described hereinabove, in its preferred form, having spout 14 for pouring of the viscous liquid from container 26. However, it should be noted that without spout 14 and the associated aperture **14*c* formed in base 12 as shown in FIG. 7, the upwardly-cambered base, in conjunction with the radial pattern of tapered tangs 18 depending from skirt 16, similarly flexes and adjusts to engage the inner ring bead 26*c* of container 26** and thereby provide a tight-fitting replacement cover that closes the container for storage of the liquid.

It is apparent from the foregoing that the lid 10 is a virtually universally fitting, snap-on, self-locking, airtight container cover that further features a self-venting, virtually dripless pouring spout.

Furthermore, it is apparent that the disclosed lid 10 provides an improved replacement cover for conventional containers of viscous liquids, particularly paint, by tightly engaging the open end of the container despite nonuniformities in its size so that paint is prevented from entering the sealing channel of the container during pouring and so that unused paint may be stored for extended periods without spoiling or skimming. In addition, the disclosed lid 10 minimizes waste and mess by inherently venting air into the container during normal pouring operations so that the paint may be dispensed in a smooth, even flow controllable by the user and by also preventing dripping of the paint onto the sides of a container after a pouring operation. The lid is sturdy, reliable, easy to handle and clean, and economical to manufacture.

Obviously other embodiments and modifications of the present invention will readily come to those of ordinary skill in the art having the benefit of the teachings presented in the foregoing description and drawings. It is therefore to be understood that various changes in the details, materials, steps, and arrangement of parts, which have been described and illustrated to explain the nature of the invention, may be made by those skilled in the art within the principle and scope of the invention as expressed in the appended claims.

We claim:

1. A lid, for a container having a U-shaped sealing channel the walls of which terminate in inner and outer ring beads, comprising:

a disc-shaped base of flexible material having an upwardly cambered surface and an integral annular skirt depending from said base, said skirt having inner and outer surfaces, said outer surface having an integral annular sealing groove for closely engaging said inner ring bead, said outer surface being axially longer than said inner surface and spaced inwardly from the periphery of said base;

a plurality of integral flexible wedge shaped tangs regularly spaced about the circumference of said skirt and pendent therefrom, each of said tangs having an inner face radially coextensive with the inner surface of said skirt and substantially parallel to the center line of said base and having an outer face extending downwardly and inwardly from a radius intermediate the periphery of the base and the outer surface of said skirt; and an integral, conically tapering, radially offset spout projecting upwardly at an inclined attitude from said base and terminating in a flared sharp-edged lip projecting beyond and above the periphery of said base, said spout having a neck formed below said lid with an interior diameter smaller than the remainder of said spout.

2. A lid, for a container having a U-shaped sealing channel the walls of which terminate in inner and outer ring beads, comprising:

a disc-shaped base of flexible material having an upwardly cambered surface and an integral annular skirt depending from said base, said skirt having inner and outer surfaces, said outer surface having an integral annular sealing groove for closely engaging said inner ring bead, said outer surface being axially longer than said inner surface and spaced inwardly from the periphery of said base; and a plurality of integral flexible wedge shaped tangs regularly spaced about the circumference of said skirt and pendent therefrom, each of said tangs having an inner face radially coextensive with the inner surface of said skirt and substantially parallel to the center line of said base and having an outer face extending downwardly and inwardly from a radius intermediate the periphery of the base and the outer surface of said skirt.

* * * * *